US006927696B2

(12) United States Patent
Wasson Coley et al.

(10) Patent No.: US 6,927,696 B2
(45) Date of Patent: Aug. 9, 2005

(54) VIEWING DISTANCE SAFETY SYSTEM

(76) Inventors: Ann D. Wasson Coley, 1009 Park Ave., Apt. 14, New York, NY (US) 10028; Christopher Cosentino, 324 Mountain Rd. #3, Union City, NJ (US) 07087

( * ) Notice: Subject to any disclaimer, the term of this patent is extended or adjusted under 35 U.S.C. 154(b) by 123 days.

(21) Appl. No.: 10/448,211

(22) Filed: May 30, 2003

(65) Prior Publication Data

US 2004/0239517 A1 Dec. 2, 2004

(51) Int. Cl.[7] ..... G08B 21/00
(52) U.S. Cl. ..... 340/686.6; 340/555; 340/552
(58) Field of Search ..... 340/686.6, 567, 340/571, 573.1, 555, 557, 552, 600, 540

(56) References Cited

U.S. PATENT DOCUMENTS 4,321,593 A * 3/1982 Ho et al. ..... 340/541
4,716,469 A * 12/1987 Kim et al. ..... 348/818
4,831,448 A * 5/1989 Park ..... 725/25
4,835,614 A * 5/1989 Ryu ..... 725/25
4,843,464 A * 6/1989 Choi ..... 348/163
4,897,630 A * 1/1990 Nykerk ..... 340/426.25
4,967,083 A * 10/1990 Kornbrekke et al. ..... 250/341.7
5,355,180 A * 10/1994 Back ..... 348/734
5,408,276 A * 4/1995 Morales ..... 348/818
5,495,302 A * 2/1996 Abruna ..... 348/819
5,541,664 A * 7/1996 Cuadrado ..... 725/25
5,604,479 A * 2/1997 Chang ..... 340/384.7
6,459,375 B1 * 10/2002 Wallace ..... 340/569

* cited by examiner

*Primary Examiner*—Daniel Wu
*Assistant Examiner*—Travis Hunnings
(74) *Attorney, Agent, or Firm*—Bradford E. Kile, Esq.; Kile Goekjian Reed & McManus PLLC

(57) ABSTRACT

A viewing distance safety system, utilizing a viewing distance safety device having two ultrasonic sensor modules at a particular angle to each other to achieve a wide field of view, and includes an adjustable, user selected, distance threshold setting that activates a warning when an object or person enters the region within the threshold distance. The system emits a warning when the threshold distance has been crossed, and, once the distance is cleared, the warning stops and the system resets itself. The system allows a voice message to be recorded for playback when an alarm is activated by crossing into the threshold distance.

6 Claims, 6 Drawing Sheets

VIEWING DISTANCE SAFETY SYSTEM

BACKGROUND OF THE INVENTION

1. Field of the Invention

This invention relates to a protective system and device for safely viewing television or other viewing apparatuses. More specifically, this invention relates to a system that is capable of sensing objects within a field of view and activating a user selected warning or tone. The subject system, using microprocessor technology coupled with miniaturized sonar sensors, creates a field of view from a television, or other viewing apparatus, that senses objects in that field of view and generates a warning when a user selected threshold distance within the field of view has been crossed. Further, the subject system, using a microprocessor controller, allows additional inputs and outputs to be added to the base device, used for sensing and alarming, to adapt to various operating or environmental conditions where the system is used. The subject system allows for accurate and flexible sensing for application to a multitude of viewing situations in order to reduce the harmful or negative physical effects of viewing apparatuses, such as televisions, when watching them in close proximity.

2. Description of the Prior Art

There are a variety of devices and systems utilized to monitor safe viewing distances. Many of these systems and devices are capable of sensing the presence of objects within a defined area, commonly called a field of view. Upon sensing an object within the field of view, these prior art devices and systems respond to the object by various means. In one prior art embodiment, an object sensed within a field of view alters the output on the viewing apparatus, cuts off the control device, and/or, represses visual transmission from the viewing apparatus. Moreover, many devices and systems in the prior art, emit an audible alarm, such as a buzzer, bell, or voice upon sensing an object breaching a predetermined or user defined threshold in a field of view. However, no such device in the prior art allows an operator to select and record a voice warning when an object is sensed within a field of view upon breaching a threshold.

Systems and devices in the prior art allow a variable range to be selected for activating a response to a sensed object. However, the prior art does not teach of a system or device that emits a warning when a minimum distance is exceeded, and, once the minimum distance is cleared, stops emitting the warning and resets itself.

At least one prior art system or device teaches of a sensing device that plugs into a power outlet, such as a wall mount outlet, and is connected to a viewing apparatus, such as a television, via receiver. However, the prior art does not teach of a system or device that connects into either a power outlet or an auxiliary power outlet on a viewing apparatus, permitting the viewing apparatus to be unaltered when a threshold viewing distance is breached.

Accordingly, there is a need for a system that allows a user to select and record a voice warning used when an object is sensed crossing a threshold distance within a field of view. Moreover, there is a need for a system that allows the threshold distance to be adjusted, emitting a warning when an object is sensed within the defined threshold distance, and stops emitting said warning and resets when the threshold distance is cleared. Further, there is a need for a viewing distance safety system that allows the flexibility of not having to connect a sensing device to a viewing apparatus in order to operate a system/device capable of warning when a user selected safe threshold viewing distance has been breached.

OBJECTS OF THE INVENTION

It is a general object of the invention to provide a novel system for viewing distance safety that will eliminate or minimize problems and limitations of the type previously described.

It is a specific object of the invention to provide a novel system for viewing distance safety with an ability to provide protection from the harmful effects of viewing television and other apparatuses in close proximity by providing warnings when a user specified threshold distance within the field of view has been crossed.

It is a further object of the invention to provide a novel system for viewing distance safety, utilizing two ultrasonic sensor modules at an angle, with respect to each other, to achieve a wide sensing angle.

Another object of the invention is to provide a system for viewing distance safety, allowing a user to select an audio warning.

It is a related object of the invention to provide a system for viewing distance safety, allowing a user to select and record a voice warning.

Another object of the invention is a variable activation range, allowing users to set a certain threshold within a field of view.

SUMMARY OF THE INVENTION

The present invention provides a system for providing protection from the harmful effects of viewing apparatuses when watched in close proximity and assisting in supervision of children or other persons in need of supervision to keep them at a safe viewing distance from televisions and other viewing apparatuses. In a preferred embodiment, the present invention creates a field of view, approximately ninety degrees wide and extending up to fifteen feet away from the sensing unit. Furthermore, the present invention allows an adjustable threshold sensing distance within the field of view, providing an alarm when the threshold is crossed. The present invention allows the supervisory user to select an alarm, which is either a tone or a recorded voice message when the threshold sensing distance is crossed. Additionally, the present invention is not limited to viewing distance safety and is applicable to any situation where an accurate and flexible distance sensor is required.

The foregoing is achieved by configuring a sensing unit to a particular environment, viewing or otherwise. More specifically, the sensing unit utilizes modern microprocessor technology coupled with miniaturized sonar sensors to create a field of view. The sonar sensors are set at a particular angle with respect to each other to maximize the field of view. Further, the sensing unit contains a potentiometer that allows the threshold sensing distance to be adjustable, within the field of view, and an additional potentiometer allows the volume of a recorded voice message to be adjusted when the voice recording alarm option is selected. Regardless of which alarm mode is selected, when the alarm is activated LED lights blink to signal the event.

DRAWINGS

Other objects and advantages of the present invention will become apparent from the following detailed description of preferred embodiments thereof taken in conjunction with the accompanying drawings, wherein.

DETAILED DESCRIPTION

Figure 1:
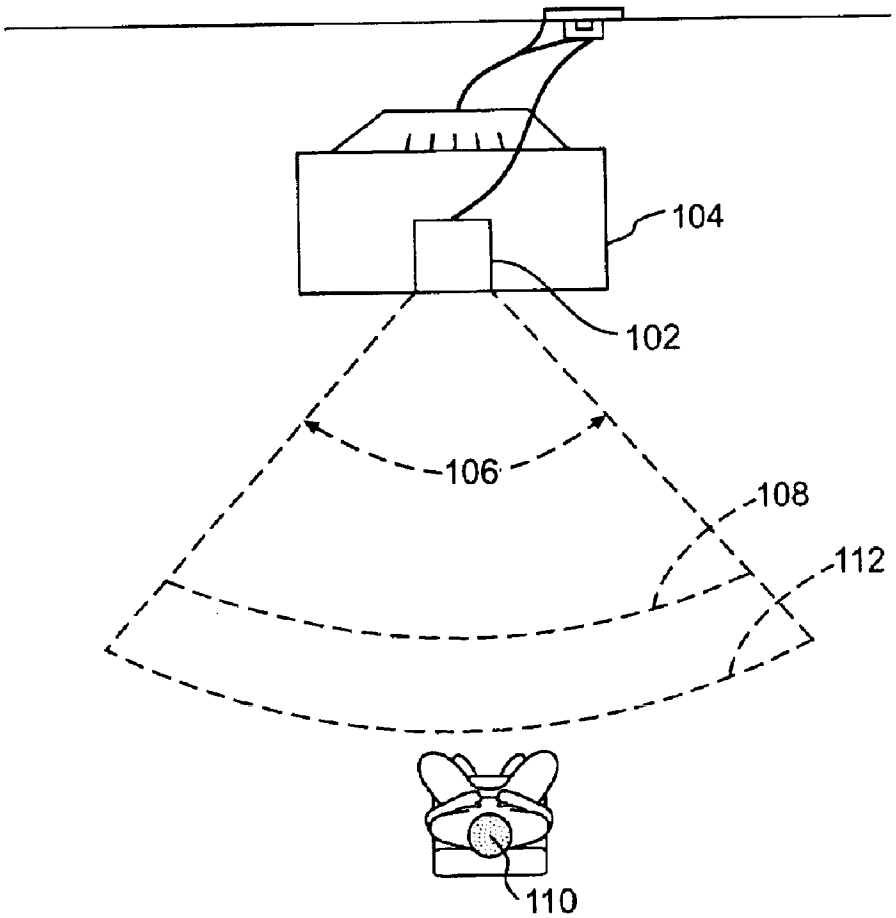
FIG. 1 is a schematic of a situation in which a viewing distance safety system would be utilized, wherein the field of view and threshold distance are visible.

Referring to the drawings, particular embodiments of the present invention illustrate the advantages of the subject viewing distance safety system. Referring to FIG. 1, a schematic of situation in which a viewing distance safety system would be utilized is shown. A viewing distance safety device 102 is placed in a position to monitor a field of view 106 of a viewing apparatus 104. The position of the viewing distance safety device 102 need not be placed in close proximity to the viewing apparatus 104, as long as it is capable of monitoring the desired field of view 106. The viewing safety device 102 utilizes two ultrasonic sensing devices (See FIGS. 4A–5B) to monitor a threshold distance 108 within the field of view 106. The threshold distance 108 is set by a supervisory user, which is equal to or less than the maximum distance 112 of the field of view 106. The threshold distance 108 is adjustable by the supervisory user. The threshold distance 108 is the minimum distance a supervisory user desires a supervised user 110, such as a child, to view the viewing apparatus 104.

In the preferred embodiment of the subject invention the viewing safety device 102 does not require connection to the viewing apparatus 104. The viewing safety device 102 only requires a power source, which may or may not be present on the viewing device, because the viewing safety device 102 does not alter the display of the viewing apparatus 104 and does not require that the viewing apparatus 104 be turned on.

Figure 2:
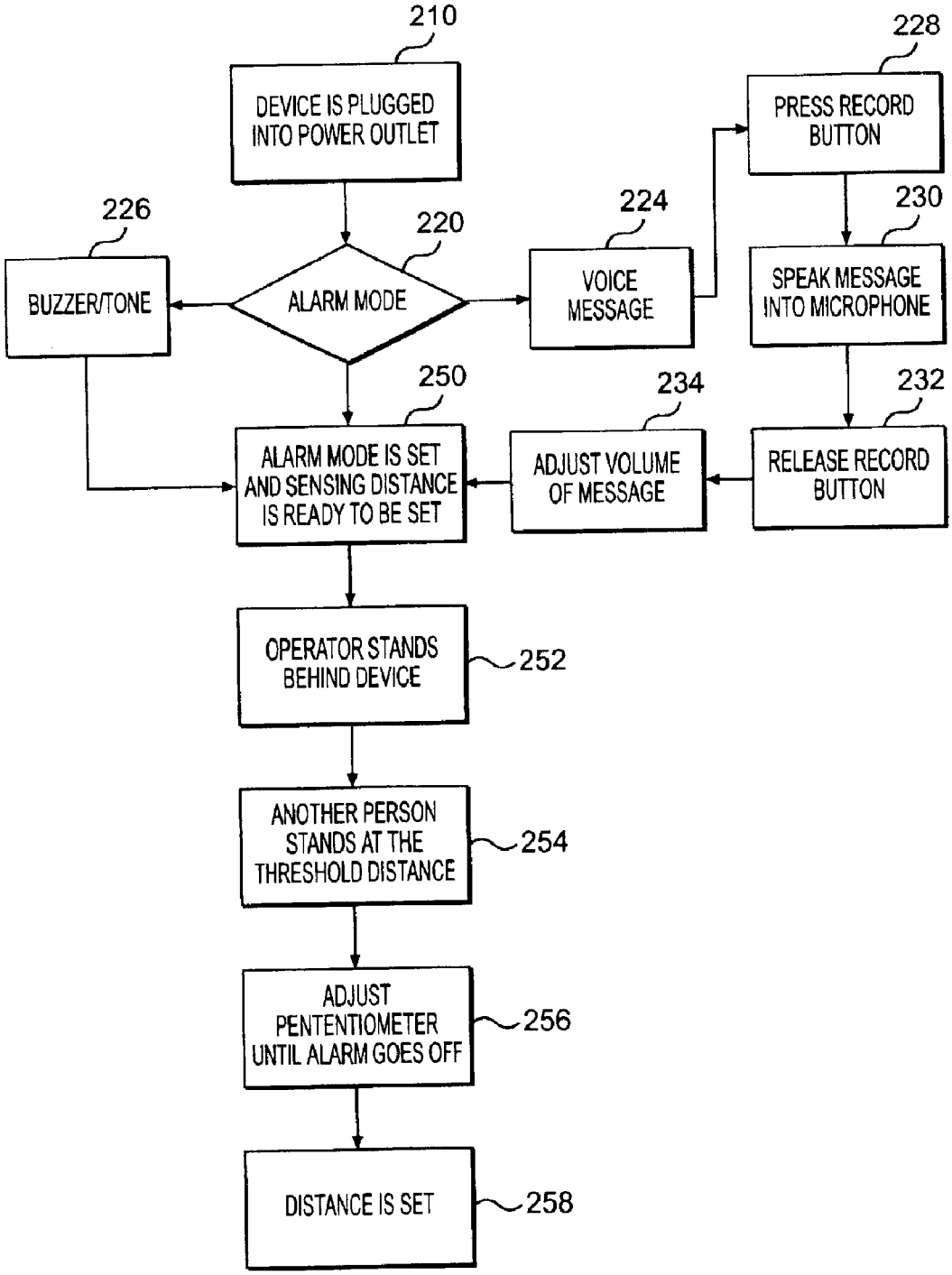
FIG. 2 is a flowchart illustrating the steps in setting up the subject viewing distance safety system.

Referring to FIG. 2, a flowchart for setting up the subject viewing distance safety system is shown. First, the viewing distance safety device is plugged into an electrical wall outlet (or other suitable power supply) (step 210). Next, an operator selects an alarm mode (step 220). The alarm mode in the preferred embodiment is an audio alarm that a user can select as either a voice message (step 224) or a buzzer/tone (step 226). However, an alternative embodiment includes an alarm mode with a visual alarm, allowing the alarm to effectively warn hearing impaired viewers. If the voice message option was selected, the operator may record a voice message by pressing a record button on the viewing system safety device (step 228), speaking the desired message into a microphone (step 230), and releasing the record button when the operator has completed the desired voice message (step 232). Then, the operator can adjust the playback volume of the message (step 234). Once the alarm mode is selected, the sensing distance is ready to be set (step 250). Setting the sensing distance requires two people. The sensing distance is set by having the operator of the viewing distance safety device stand behind it (step 252), while another person acts as an object to be sensed at a desired threshold position within the field of view (step 254). The operator then adjusts a distance potentiometer until the alarm just sounds (step 256). If the operator is satisfied with this distance, the threshold distance is set (step 258).

When an alarm is to be sounded, the system determines whether voice message or buzzer/tone option was selected, and activates the selected alarm. If the voice message option was selected, the operator can adjust the playback volume of the message while the alarm sounds.

With respect to the voice message that is used, at an operator's preference, as an alarm/warning, the operator has the unlimited option to erase and record the voice message. In the preferred embodiment of the invention the voice message is saved as data using a voice microchip. The maximum length of the voice message is dependent on the amount of data the voice microchip can store.

Figure 3:
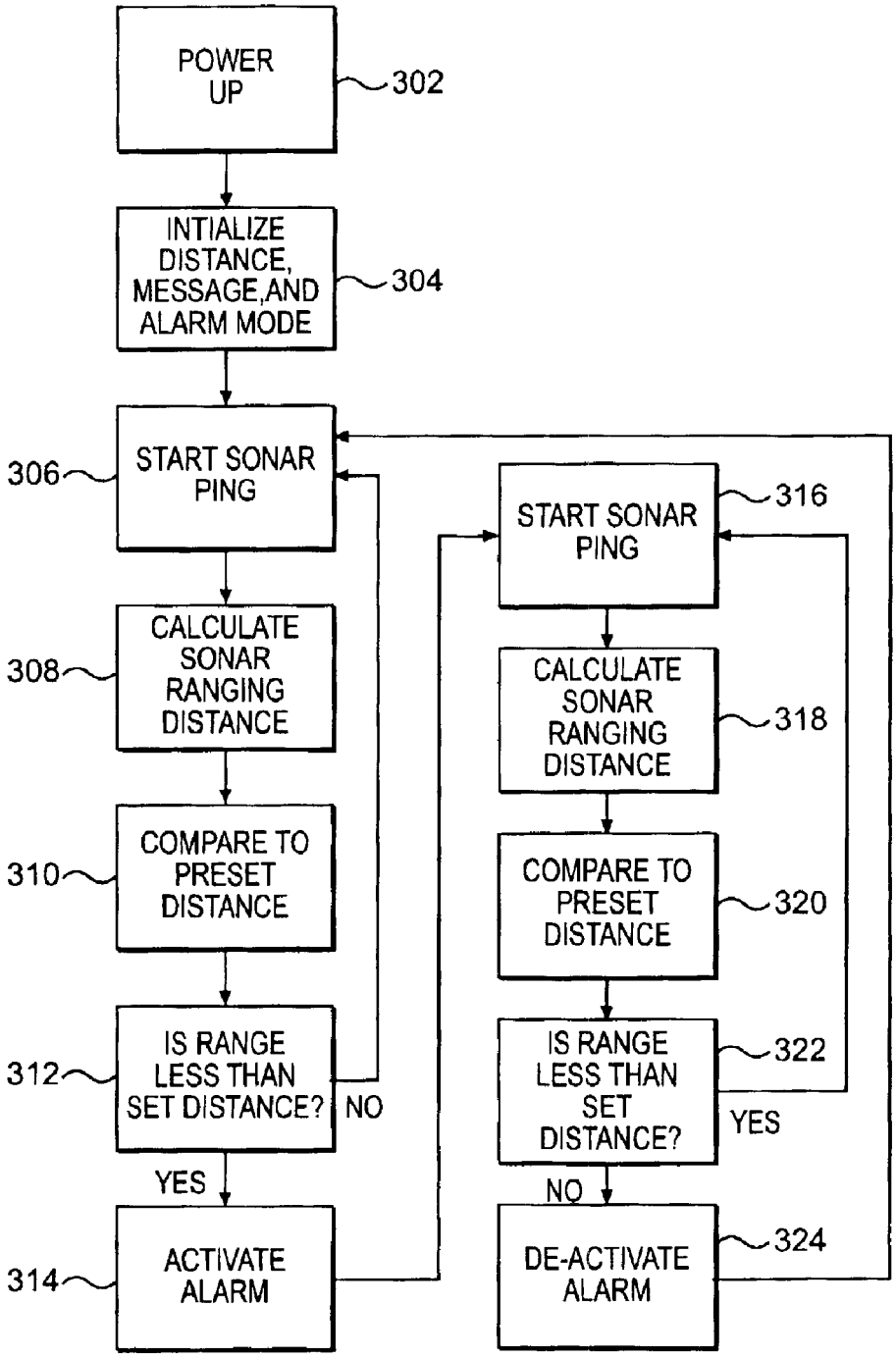
FIG. 3 is an operational flowchart for the subject viewing distance safety system, illustrating how the system senses and responds to objects in its field of view.

Referring to FIG. 3, an operational flowchart for the subject viewing distance safety system is shown. The following description of FIG. 3 illustrates how the viewing distance safety device activates an alarm while an object breaches a preset threshold distance and resets itself, i.e. de-activates, once an object no longer breaches the preset threshold distance.

The viewing distance safety device is first plugged in and turned on (step 302). Once the viewing distance safety device is turned on, an alarm mode, warning, and distance are initialized (step 304). The alarm mode in the preferred embodiment is an audio alarm that is either a voice message or a buzzer. At this point the viewing distance safety device is able to detect objects in the field of view. Accordingly, the viewing distance safety device starts a sonar ping (step 306). In the preferred embodiment of the invention the sonar ping procedure begins when a sensing device's sonar emitter emits a controlled pulse of ultrasonic sound and then turns off. A sensing device's sonar detector then waits for a reflected pulse. If a reflected pulse is sensed, the time from emission of the pulse to detection of the reflected pulse is recorded. The data is collected by the sensing device so that the distance to the object causing the reflected pulse can be calculated (e.g., using the speed of sound in air). If no reflected pulse is detected, then there is no object within the maximum sensing range. The viewing distance safety device then calculates sonar ranging distance (step 308), and compares the calculated sonar ranging distance to a preset threshold distance (step 310). In the preferred embodiment a threshold distance is determined during power up of the viewing distance safety device and is always defined. The viewing distance safety device then determines whether the calculated sonar ranging distance is less than the preset threshold distance (step 312). If the calculated sonar ranging distance is not less than the preset distance, then the device starts another sonar ping, repeating steps 306-312 continually as long as calculated sonar ranging distance is not less than the preset distance. If the calculated sonar ranging distance is less than the preset distance, then the alarm is activated (step 314).

Once the alarm is activated the viewing distance safety device begins a series of steps similar to steps 306–312. The device starts a sonar ping (step 316), and then calculates a sonar ranging distance (step 318). The calculated sonar ranging distance is compared to the preset distance (step 320), which is the same as that in step 310, and the device determines whether the calculated sonar ranging distance is less than the preset distance (step 322). If the calculated sonar ranging distance is less than the preset distance, then the device starts another sonar ping, repeating steps 316–322 continually as long as calculated sonar ranging distance is less than the preset distance, allowing the alarm to continue to be activated. If the calculated sonar ranging distance is not less than the preset distance, then the alarm is de-activated (step 324).

Figure 4B:
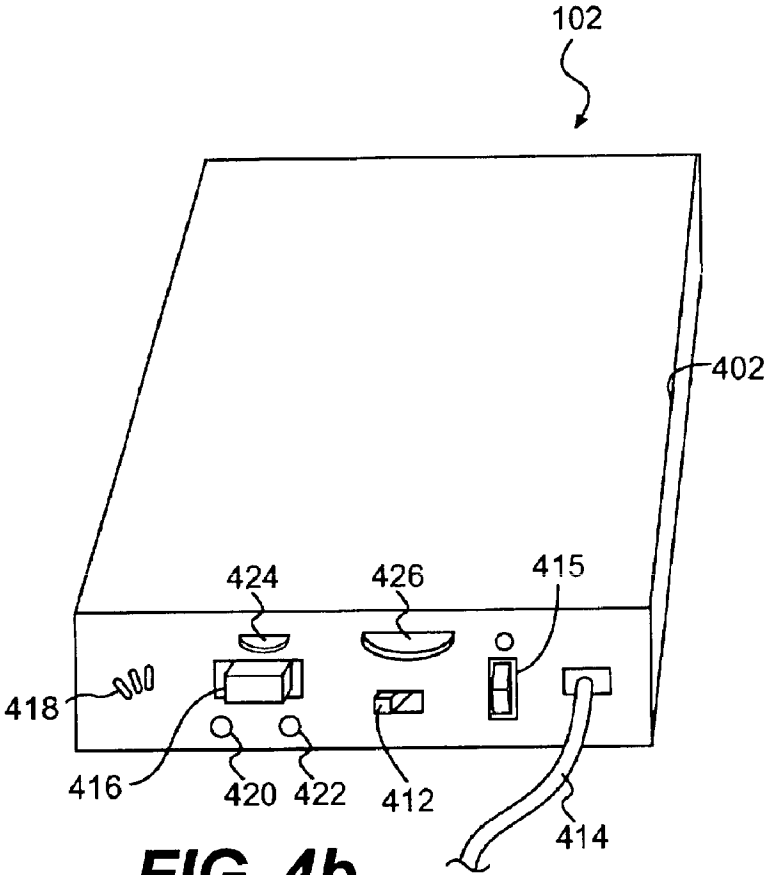
FIGS. 4A and 4B are a front and back view, respectively, of a viewing distance safety device in accordance with a preferred embodiment of the subject invention.
Figure 4A:
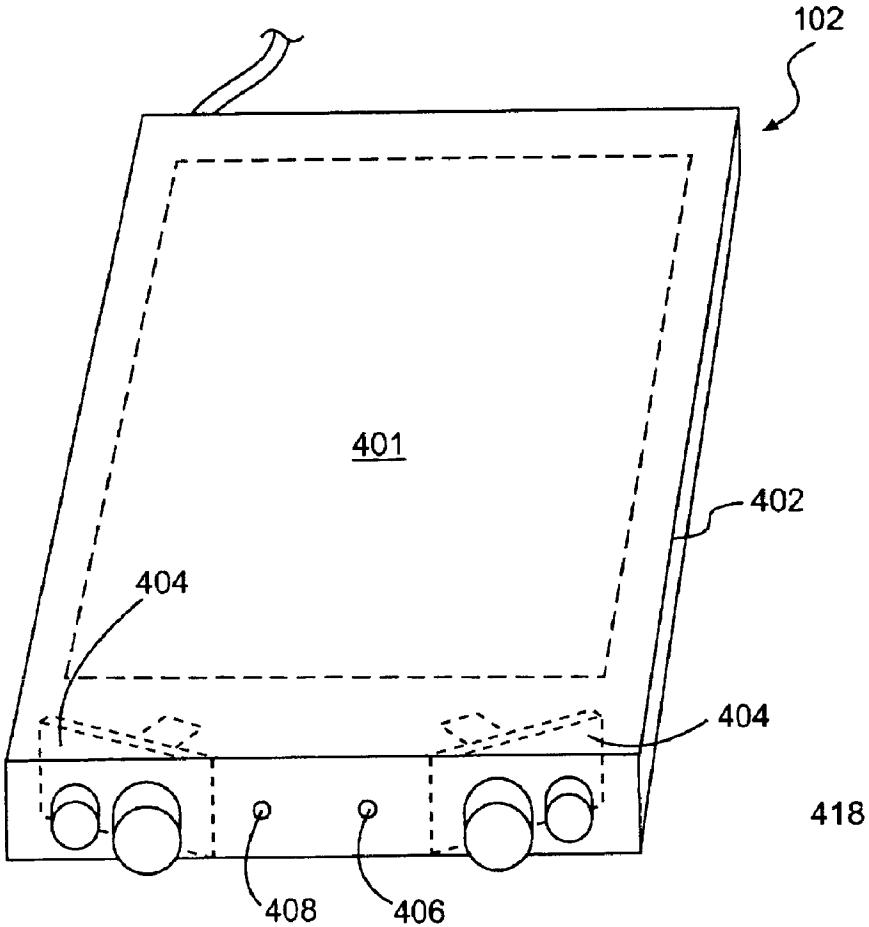

FIGS. 4A and 4B show a viewing distance safety device 102 in accordance with a preferred embodiment of the invention. The viewing safety device has an outer shell 402 which houses and protects the internal components 401 (See FIGS. 5A–5B).

Referring specifically to FIG. 4A, a view of the front of the viewing safety device is shown. Two ultrasonic sensing devices 404 are placed at an angle with respect to each other to create a field of view to monitor. A portion of each of the respective ultrasonic sensing devices 404 protrude from the outer shell 402. Also visible on the front of the viewing distance safety device are two LED lights, a green LED light 406 and a red LED light 408. These LED lights provide a visual indication of whether a threshold distance has been breached. When the green LED light 406 is lit, it signifies that no object is breaching the threshold distance within the field of view. When, the red LED light 408 is lit, it signifies that an object is breaching the threshold distance within the field of view.

Referring specifically to FIG. 4B, a view of the back of a viewing distance safety device 102 is shown. A power cord 414 extends from the outer shell 402, where it can be plugged into an electrical wall outlet or other suitable power supply. An on/off switch 415 provides a means for manually shutting off the device 102. When the on/off switch 415 is in the on position, the power cord 414 allows sufficient power to be supplied to the many components of the device 102 through a series of conductive paths (See FIGS. 5A–5B). A voice/buzzer switch 412 is used to select a desired alarm mode, either voice alarm or buzzer/tone alarm. If the voice/buzzer switch 412 is positioned so that the voice alarm mode is selected, a voice message can be recorded by an operator by pushing a message record button 416. The message record button 416 allows a message to be recorded into a microphone 418. Once the message has been recorded, the operator can play back the message by pressing the replay button 420. The operator can adjust the volume of the recorded message by moving a volume level 424. The operator can also erase a message recorded on the device 102 by pressing a delete button 422.

In another preferred embodiment of the subject invention, a viewing distance safety device does not include a replay button 420 and/or a delete button 422. Thus, an operator must record over a previous recording to delete it.

In yet another preferred embodiment, a viewing distance safety device contains a recording medium, such as a voice chip, that can be used to store and playback multiple messages. In addition, a means for selecting which message is to be played is envisioned in this embodiment. Such means include, but are not limited to, the following: 1) a button or switch for selecting which message is to be played; and 2) parameters within a program routine that determine which message will be played (based on events such as distance calculation and/or frequency of breach).

Also contained on the back of the viewing distance safety device 102 is a threshold distance level 426, which is used by an operator to select a desired threshold distance (as described in FIG. 2). The threshold distance level 426 must be placed where its adjustment will not be within the field of view to allow the threshold distance to be accurately set.

Figure 5A:
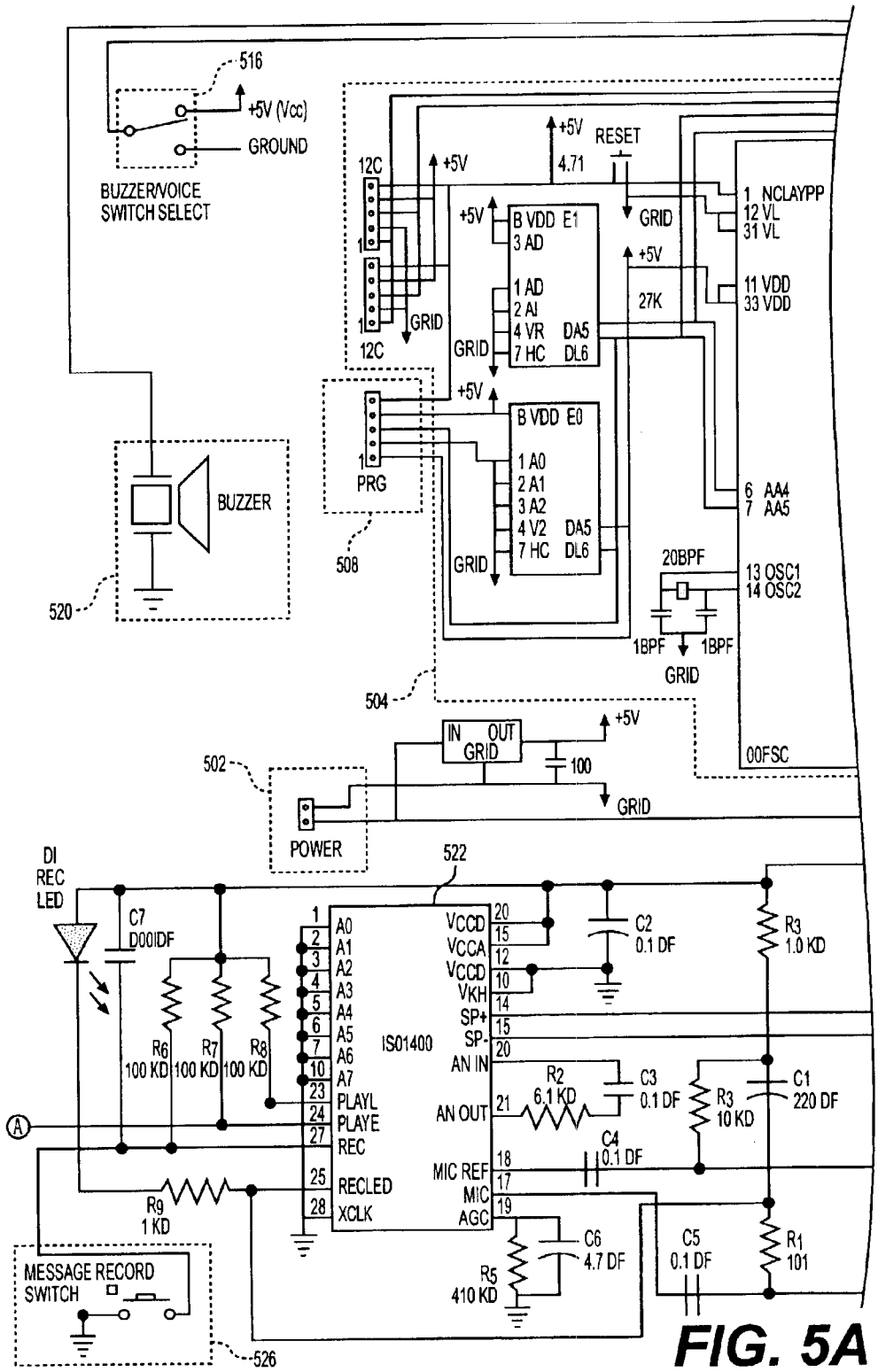
FIGS. 5A and 5B are a schematic of the interconnection of components of a viewing distance safety device.
Figure 5B:
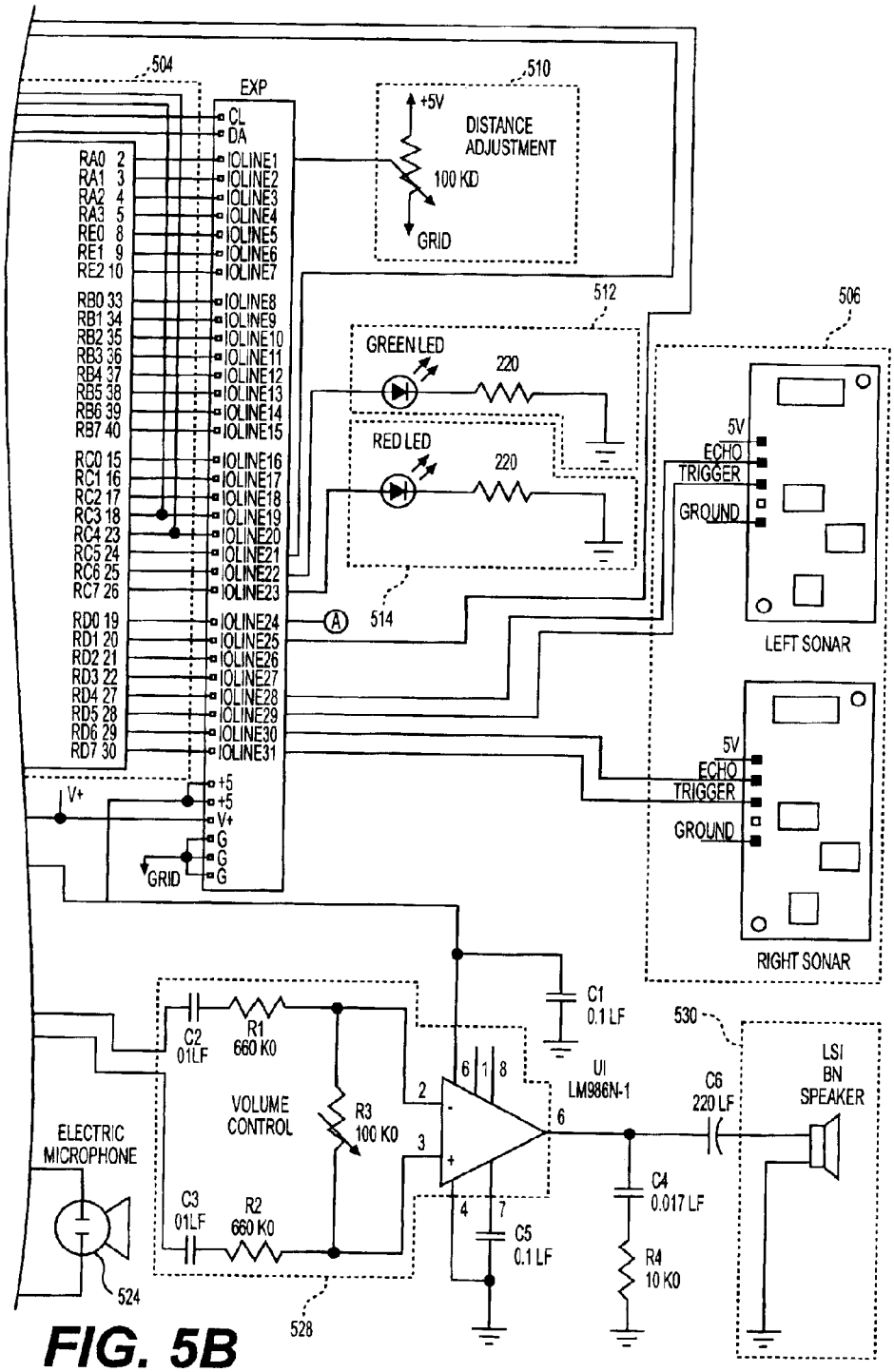

FIGS. 5A and 5B depict the interconnection of components of a viewing distance safety device in accordance with the preferred embodiment of the subject invention. These components allow the viewing distance safety device to operate and function as set forth in the descriptions of FIGS. 1–4B.

Referring to FIGS. 5A and 5B, a power source 502 is necessary to provide requisite energy for each component of the viewing distance safety device. More specifically, the power source 502 continuously routes energy to a processor 504. The processor 504 runs a program routine 508, sending commands to ultrasonic sensing devices 506. The ultrasonic sensing devices 506 receive commands from the processor 504 and transmit data back to the processor 504. The processor 504 then processes the data received from the ultrasonic sensing devices 506 through the program routine 508 (e.g., see operational flowchart described above in FIG. 3), and the program routine 508 determines which components should be activated. A distance adjustment component 510 defines a threshold distance parameter in the program routine 508. If data received from the ultrasonic sensing devices 506 represents a value that is greater than the threshold distance parameter, a green LED light 512 is lit, signifying that no object is breaching the threshold distance. If data received from the ultrasonic sensing devices 506 represents a value that is less than the threshold distance parameter, a red LED light 514 is lit and a signal is sent on to a voice/buzzer switch 516, signifying that an object is breaching the threshold distance. The position of the voice/buzzer switch 516 determines which alarm mode will be activated, and routes the signal accordingly.

If the voice/buzzer switch 516 is positioned so that the buzzer alarm mode is selected, the signal is routed to a buzzer 520. The buzzer 520 will continue to be activated as long as the program routine 508 determines that the value from the ultrasonic sensing devices 506 is less than the threshold distance parameter.

If the voice/buzzer switch 516 is positioned so that the voice alarm mode is selected, the signal from the processor is routed to a voice alarm processor 522. The voice alarm processor 522 stores a recorded warning from input received from a microphone 524 when a message record switch 526 is pressed. A volume control 528 defines the volume at which the recorded warning is played on a speaker 530. The playback volume of the recorded warning, defined by the volume control 528, is stored on the processor in one embodiment of the invention. Alternatively, in another embodiment of the invention the volume control 528 determines the volume of the recorded warning upon receiving a signal from the processor. The voice alarm processor 522 retrieves the recorded warning from memory and transmits the recorded warning onto the speaker 530 where it becomes audible. The recorded warning will loop continuously as long as the program routine 508 determines that the value from the ultrasonic sensing devices 506 is less than the threshold distance parameter. In alternative embodiments, the recorded message may get louder and louder if the threshold distance is continually breached.

The present invention differs from prior art systems and devices for viewing distance safety and sensing, by utilizing the option to select and record voice messages to be used as alarms. Moreover, the present invention differs from the prior art by allowing for a greater area to be monitored, with respect to the field of view, through utilization of two miniaturized sonar sensors set at a particular angle with respect to each other. In addition to the above features the present invention also provides a combination of configurable features not existing in the prior art, allowing users to select alarm type, volume of alarm, and threshold distance.

In an alternative embodiment of the invention, if the unit is unplugged during use, it emits a warning unless deactivated via a hidden switch. In another embodiment of the invention, the warning device can be adjusted by the user, via a control knob, to activate a light alarm and/or a louder, longer, or different audio signal if the set minimum distance is repeatedly exceeded.

While particular embodiments of the invention have been illustrated and described in detail herein, it should be understood that various changes and modifications may be made to the invention without departing from the spirit and intent of the invention as defined by the scope of the appended claims.

SUMMARY OF MAJOR ADVANTAGES OF THE INVENTION

After reading and understanding the foregoing detailed description of a viewing distance safety system in accordance with preferred embodiments of the invention, it will be appreciated that several distinct advantages are achieved.

Without attempting to detail all of the advantages specifically disclosed or inherent in the complete disclosure, the subject viewing distance safety system will allow users to set safe viewing distances from viewing apparatuses, such as televisions. The viewing distance safety device covers a wide field of view by utilizing two ultrasonic sensor modules, which can activate an alarm warning, either a tone or user selected and recorded voice message, when an object enters an adjustable user selected threshold distance. The subject system automatically resets itself once an object no longer within the area defined by the selected threshold distance.

Additionally, the present invention does not interfere with the visual display of a viewing apparatus upon sensing an object within the supervisory user-selected field of view, and does not require a connection to the viewing apparatus.

The difficulties, limitations and desires suggested in the preceding are not intended to be exhaustive, but rather are among many which demonstrate that prior art devices and systems for viewing distance safety will admit to worthwhile improvement.

What is claimed:

1. A viewing distance safety system for monitoring a field of view of a visual screen said viewing distance safety system comprising:

a viewing distance safety device operably positioned in close proximity to a visual screen of a viewing apparatus, wherein said viewing distance safety device comprises two sensing devices, each at a set angle off an axis, for creating a field of view and detecting objects within said field of view, wherein said field of view is approximately ninety degrees, at least one processor for evaluating and responding to data received from said sensing devices, a means for adjusting a predetermined threshold distance, and a means for producing an alarm when said threshold distance is breached, wherein said threshold distance activates said alarm as long as an object breaches an area defined by said threshold distance, and said alarm is an audible sound with an adjustable volume and said sound is selectable between a machine generated sound and a recorded warning, wherein a means for acquiring and replaying said recorded warning is provided; and at least one visual indicator for signaling whether or not said threshold distance within said field of view is breached.

2. A viewing distance safety system, as defined in claim 1 wherein:

said viewing distance safety device does not alter the output of said viewing apparatus and does not require said viewing distance safety device to be connected to said viewing apparatus.

3. A viewing distance safety system as defined in claim 1 wherein:

said recorded warning includes a plurality of recorded warnings, wherein said viewing distance safety device contains a means for acquiring and replaying said plurality of recorded warnings.

4. A viewing distance safety device for monitoring a field of view comprising:

two sensing devices, each at a set angle off an axis, for creating a field of view and detecting objects that encroach within a predetermined threshold distance, wherein said field of view is approximately ninety degrees, and said viewing distance safety device provides a means for adjusting said threshold distance;

at least one processor for evaluating and responding to data received from said sensing devices;

an alarm mechanism wherein when an object encroaches said threshold distance, said sensing devices transmit data to said at least one processor which, in turn activates an alarm, keeps said alarm active as long as an object encroaches said threshold distance, and deactivates said alarm when no object is within said threshold distance, wherein said alarm is an audible sound and said safety device provides a means for adjusting the volume of said sound, wherein said viewing distance safety device provides a means for selecting between a machine generated sound and a recorded warning, wherein said viewing distance safety device provides a means for acquiring and replaying said recorded warning; and a plurality of visual indicators for signaling whether or not a threshold distance within said field of view is breached, wherein at least one said indicators signals that said threshold distance is being breached, and at least one of said indicators signals that said threshold distance is not being breached.

5. A viewing distance safety device, as defined in claim 4 wherein:

said viewing distance safety device does not alter the output of said viewing apparatus and does not require said viewing distance safety device to be connected to said viewing apparatus.

6. A viewing distance safety device as defined in claim 4 wherein:

said recorded warning includes a plurality of recorded warnings, wherein said viewing distance safety device contains a means for acquiring and replaying said plurality of recorded warnings.

* * * * *